United States Patent [19]

Tschudin-Mahrer

[11] Patent Number: 4,839,223

[45] Date of Patent: Jun. 13, 1989

[54] FIRE-PROTECTIVE SEALING ELEMENT

[75] Inventor: Rolf Tschudin-Mahrer, Lausen, Switzerland

[73] Assignee: Irbit Research & Consulting AG, Fribourg, Switzerland

[21] Appl. No.: 261,137

[22] Filed: Oct. 24, 1988

[30] Foreign Application Priority Data

Oct. 22, 1987 [DE] Fed. Rep. of Germany ..... 3735779

[51] Int. Cl.[4] ..... B32B 3/26; B32B 9/00

[52] U.S. Cl. ..... 428/317.1; 428/57; 428/305.5; 428/317.3; 428/317.9; 428/921

[58] Field of Search ..... 428/57, 317.1, 317.3, 428/317.9, 920, 921

[56] References Cited

U.S. PATENT DOCUMENTS

| | | | |
|---|---|---|---|
| 4,401,716 | 8/1983 | Tschudin-Mahrer | 428/317.3 |
| 4,530,877 | 7/1985 | Hadley | 428/305.5 |
| 4,564,550 | 1/1986 | Tschudin-Mahrer | 428/317.1 |
| 4,616,044 | 10/1986 | Fesman | 428/305.5 |
| 4,666,768 | 5/1987 | Tschudin-Mahrer | 428/318.6 |
| 4,762,746 | 8/1988 | Wesch et al. | 428/305.5 |
| 4,767,655 | 8/1988 | Tschudin-Mahrer | 428/317.1 |

*Primary Examiner*—William J. Van Balen

*Attorney, Agent, or Firm*—Watson, Cole, Grindle & Watson

[57] ABSTRACT

The invention relates to a sealing element for sealing openings in special walls subject to fire-protection requirements, brick wall breaches or the like, wherein for cost-effective manufacturability and processibility and simultaneously fire-protection assurance the sealing element is made of a precompressed strip, preferably impregnated with a chloroparaffin and neoprene base, with delayed restoration, the strip being interspersed with a heat-expanding intumescent compound in an essentially uniform distribution.

8 Claims, 3 Drawing Sheets

FIRE-PROTECTIVE SEALING ELEMENT

BACKGROUND OF THE INVENTION

1. Field of the Invention

This invention relates to a sealing element for use in sealing openings in fire-protective structures such as fire walls.

2. The Prior Art

In order to seal connecting joints, expansion joints, etc., in fire breaks, fire walls and wall break-throughs (compare also DIN 4012), it has long been known to use agents based on asbestos, such as the tradenamed product "Litaflex," or heat-expanding sealing compounds, e.g., Foamox. It is also known to insert asbestos in the form of an asbestos braid into such joints.

Such conventional sealing elements have various drawbacks. First of all, it is now known that asbestos materials are hazardous, and thus their use is to be avoided, if possible. In addition, known sealing elements may not achieve a satisfactory seat in the joints, which of course is extremely unsatisfactory since even one location where the heat or flames can penetrate destroys the effectiveness of the fire protection. In the case of joints of irregular width, the known sealing elements can be processed only with great difficulty. Moreover, a time-consuming edge pretreatment of the joints is necessary. In addition (and especially important), whether there is enough asbestos compound or heat-expanding sealing compound in the protecting joints is not controllable. And on the whole, the known sealing elements are quite expensive, not only because of the aforementioned circumstances but also due to their manufacturing costs.

On the other hand, the use of precompressed or precompacted foam tapes has been known for a long time for sealing joints in the construction industry. See, for example, *Plastics in Construction,* Vol. 15, 1980, issue 2, pages 66 to 68. See also U.S. Pat. Nos. 4,621,731 and 4,401,716. However, even if the precompressed foamed tape is impregnated, e.g., with a mixture of chloroparaffin and neoprene so as to provide for a delayed restoration and a flame-retardant property, there is no possibility of using such foam tapes when subjected to high temperatures in the range of about 800° C. because at temperatures above about 200° C. the foam begins to melt and vaporize.

The object of the present invention is therefore to design and further develop the known sealing elements for walls, wall break-throughs or the like, which are subject to special fire-protection requirements in such a manner that greater fire-protection is achieved and production and processibility are more cost effective.

SUMMARY OF THE INVENTION

It has been surprisingly found that an interspersing in a prior art foam, such as a polyurethane foam, with a thermally-expandable sealing material, e.g., an intumescent material based on urea derivative ammonium polyphosphate polyacetate, supplements the inadequate thermal stability of the foam, creating a more efficient sealing material which meets fire-protection requirements. Due to the foam, which the heat-expanding sealing compound intersperses, this sealing compound is very finely and homogeneously distributed. When subject to heat, the heat-expanding compound is extremely quickly activated due to the very large surface of the heat-expanding compound, which is provided over the entire surface area of the sealing element, and the whole sealing element, on the surface area subject to thermal stress, is transformed into a solid, superrefractory or thermally stable body. Via the depth the transformation takes place only over a relatively negligible length, precisely because the heat-expanding compound can quite rapidly and comprehensively respond to the thermal load. In this case the fact that the heat-expanding compound in a non-stressed state is also effective is an advantage, since the compound is not only the cause of the aforementioned increase in surface but also makes it possible for the individual compound clusters to expand unimpeded.

Another surprising advantage is the fact that the overall heat transfer coefficient of a joint with such a sealing element is very small, even when subjected to temperatures in the range of 800° C. or more. In the relatively large region of the joint depth in which the heat-expanding material is not transformed, the good overall heat transfer properties of the open-porous foam material are essentially retained. Due to the uniform interspersion of the foam with the heat-expandable compound, it is also possible to very uniformly distribute this compound in the joints.

The precompression of the foam tape is preferably in the 50% range. Such a precompressed foam tape provides an optimal-ratio between interspersion of foam with heat-expanding compound and advantageous application into the joints.

Moreover, it is preferred that the heat-expanding compound is distributed in such a manner that it uniformly coats the foam structure. In addition to this, however, it is also present in the individual pores of the foam in the form of granules. For example, this can be achieved by impregnating the foam with the heat-expanding material in a liquid state and then drying. Advantageously the heat-expanding material can be mixed or interspersed with the impregnating agent, as explained above, in the manner of a dispersion.

Another surprising effect has been found that a foam strip under discussion that is impregnated and interspersed with the sealing compound has uniform compression or compaction properties in the expanded state. It is assumed that, due to the successful compression, a certain relatively small layering occurs in the foam tape. Since the more readily compactibility of the restored foam in the direction of pre-compaction is given, however, shows it in the lateral direction of the joint—in the installed state, the result is poorer compactibility in the depth direction of the joint. At the same time there is increased penetration resistance, i.e., the sealing element of the invention offers a relatively high resistance to mechanical impacts in the depth direction of the joint, without having any negative impact on the advantageous, positive processibility of the sealing element and the advantageous ready compactibility in the width direction of the joint.

In an advantageous embodiment the foam strip has a self-adhesive foil on one longitudinal side thereof. Thus it can be advantageously applied into a joint.

The invention is described in more detail with the aid of the attached drawings, taken in conjunction with the following discussion.

DETAILED DESCRIPTION OF THE PREFERRED EMBODIMENT

Figure 1:
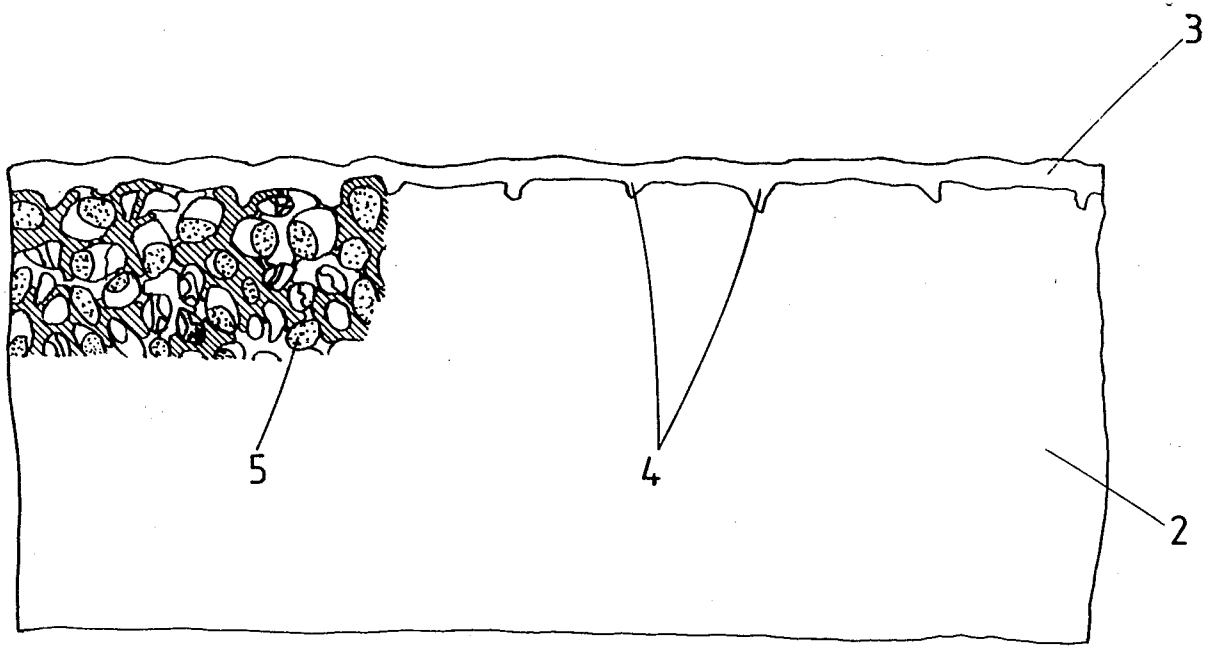
FIG. 1 is a cross-sectional view of a sealing element according to the invention.

FIG. 1 presents and illustrates, first of all, a cross-sectional view of a sealing element 1 according to the invention. The sealing element 1 comprises a foam strip 2 with self-adhesive foil 3 attached on one longitudinal side thereof. As can be seen, the self-adhesive foil 3 is securely anchored at points 4 to the foam strip 2.

The foam strip 2 is impregnated in the conventional manner and also contains an interspersed heat-expanding sealing compound (intumescent compound) in an essentially uniform distribution. On one hand, the heat-expanding sealing compound is in the form of a coating of the foam structure; in addition to this, however, it is also in the form of material clusters 5 in which the heat-expanding compound has aggregated. Thus one can speak also about granule-like aggregates.

Figure 2:
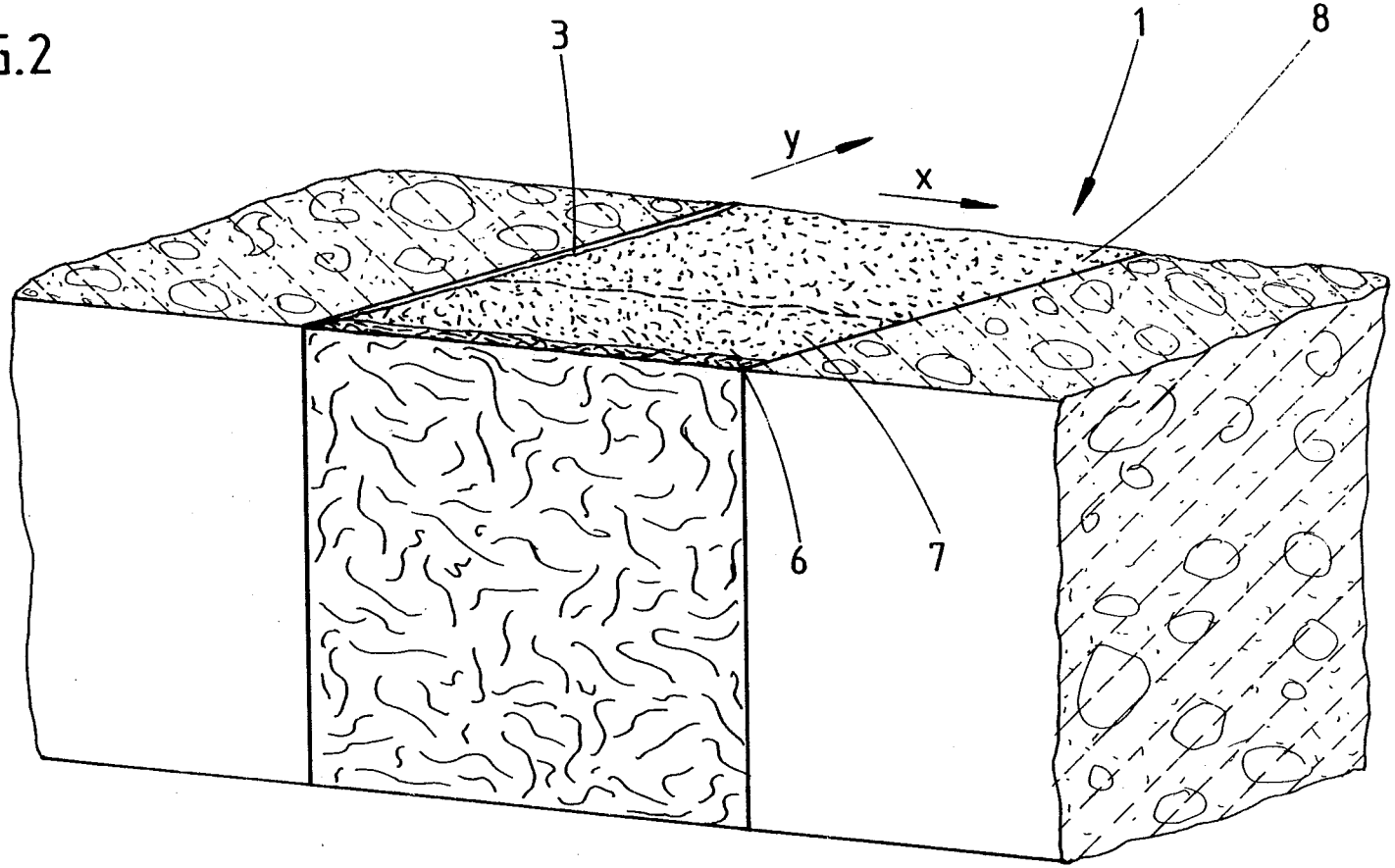
FIG. 2 is a fragmentary view of a sealing element of the invention when installed in a joint and subjected on one side to heat.

The illustration in FIG. 2 shows the sealing element 1 in a state installed in a joint. As explained above in detail, following restoration in the width direction x of the joint, which also corresponds to the direction of pre-compaction of the foam strip 2, the sealing element 1 can be compacted or compressed more readily than in the depth direction of joint y.

When the sealing element 1 of the invention is subjected to heat or flames of high temperature, for example in the range of 800° C. or higher, a layer 6 of the transformed, heat-expanding compound is formed. It is assumed that the thermal stress has occurred on that side of the sealing element 1 that corresponds to the layer 6. As illustrated on the drawing, the thickness of the layer 6 (depth direction 7) is relatively small. To this layer 6 a transition region 7 adjoins in which the foam is partially melted or vaporized, but a transformation of the heat-expanding compound has not yet occurred. This applies to temperatures ranging from about 200° C. to 800° C. To this region another region 8 adjoins in which the sealing element 1 is almost uneffected.

FIG. 2 also shows that the sealing element 1 has an adhesive foil 3 on one side.

Figure 3:
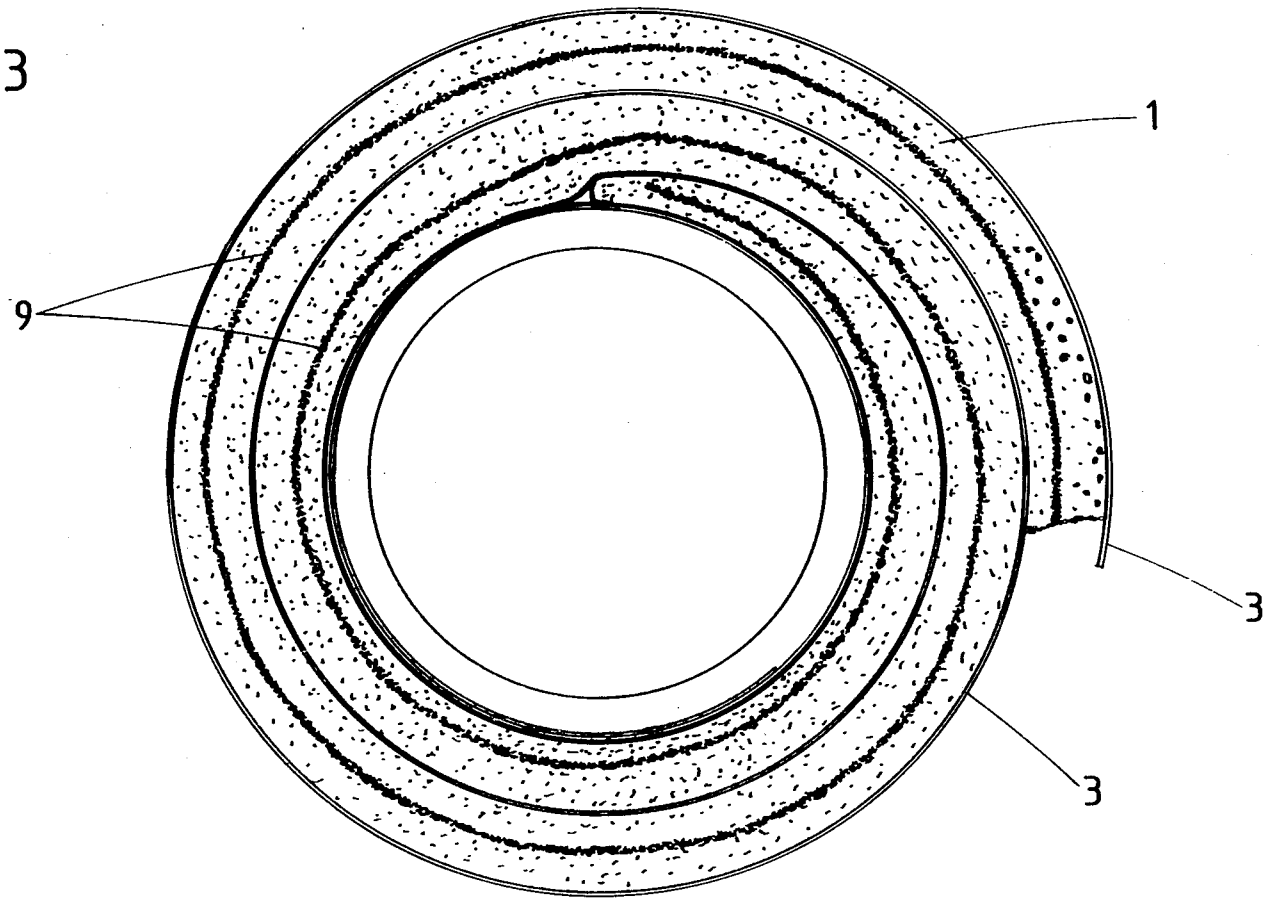
FIG. 3 is a side view of a sealing element of the invention in the wound up, pre-compacted state.

FIG. 3 shows a sealing element in the conventional rolled up format; thus it is in its pre-compacted state. The spiral highlightings 9 should clearly show that a sealing element 1 of the invention has a specific layer-like accumulation of heat-expandable compound. However, with respect thereto the illustration is quite exaggerated.

The features of the invention, disclosed in the preceding specification, the drawing and the claims, can also be meaningful for the actualization of the invention not only individually but also in any arbitrary combination.

I claim:

1. A sealing element for sealing openings in fire protective structures, said sealing element comprising a precompressed foam strip containing an essentially uniform distribution of a heat-expanding intumescent compound.

2. A sealing element according to claim 1, wherein the foam strip is precompressed to a degree of about 50%.

3. A sealing element according to claim 1, wherein the heat-expanding compound is present in individual pores of the foam strip in granule-like accumulations.

4. A sealing element according to claim 1, wherein said precompressed foam strip, after expansinn, is more readily compressible in the direction of precompression than in a direction perpendicular thereto.

5. A sealing element according to claim 1, including a self-adhesive foil on at least one longitudinal side of said foam strip.

6. A sealinq element according to claim 1, wherein said heat-expanding intumescent compound is ammonium polyphosphate polyacetate.

7. A sealing element according to claim 1, wherein said precompressed foam strip is also impregnated with a chloroparaffin and neoprene base.

8. A sealing element according to claim 1, wherein said foam strip is composed of polyurethane.

* * * * *